United States Patent [19]

Mommsen et al.

[11] 4,162,042

[45] Jul. 24, 1979

[54] SPRAY GUN SAFETY SENSOR

[75] Inventors: Gordon V. Mommsen, Brooklyn Center; Dale R. Hemming; Richard E. Hudrlik, both of Fridley, all of Minn.

[73] Assignee: Graco Inc., Minneapolis, Minn.

[21] Appl. No.: 801,935

[22] Filed: May 27, 1977

[51] Int. Cl.[2] ..... B05B 7/02

[52] U.S. Cl. ..... 239/526; 222/76

[58] Field of Search ..... 239/288-288.5, 239/289, 526, DIG. 22; 361/179, 181; 340/258 C; 307/116; 222/76

[56] References Cited

U.S. PATENT DOCUMENTS

| | | | |
|---|---|---|---|
| 3,412,292 | 11/1968 | Forbes | 361/179 X |
| 3,836,828 | 9/1974 | Siegel | 361/179 |
| 3,963,180 | 6/1976 | Wagner | 239/288.5 |

*Primary Examiner*—Robert B. Reeves
*Assistant Examiner*—Andres Kashnikow
*Attorney, Agent, or Firm*—Paul L. Sjoquist

[57] ABSTRACT

Apparatus for connecting to a paint or liquid spray gun, including an electronic sensor element in close proximity to the spray tip with an electronic circuit for generating an electric drive signal for energizing and deenergizing a solenoid which is mechanically coupled to trigger disabling relation to the spray gun actuating trigger.

12 Claims, 5 Drawing Figures

FIG. 2
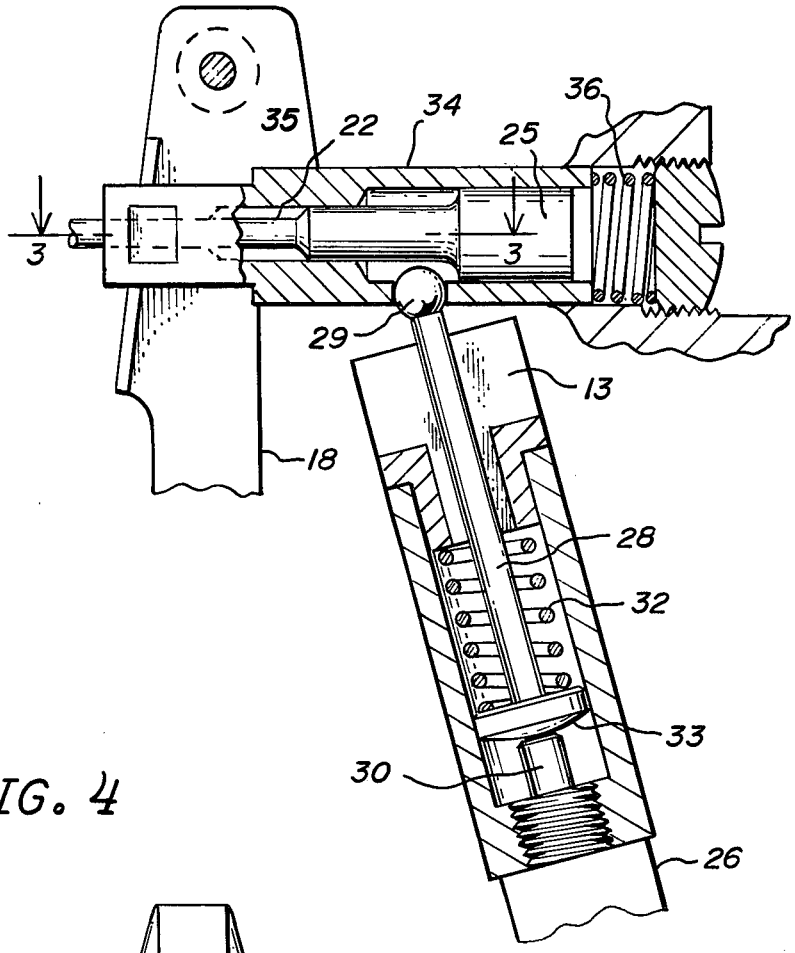
FIG. 4
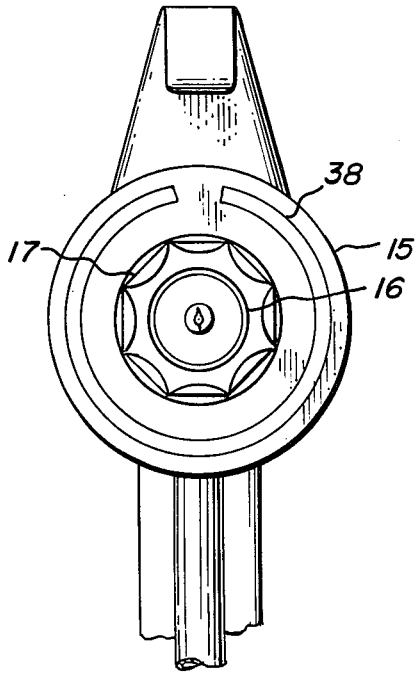
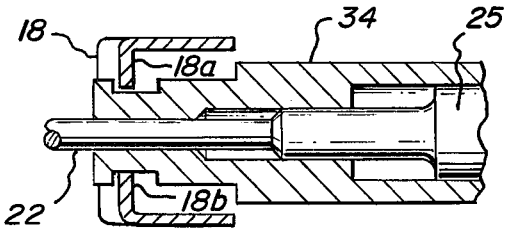
FIG. 3

SPRAY GUN SAFETY SENSOR

BACKGROUND OF THE INVENTION

This invention relates to paint or liquid spray gun apparatus, and specifically to a proximity sensor in combination with such a spray gun for purposes of detecting the presence of a human hand or other body member within a prescribed distance from the spray tip, and thereby disabling the spray gun trigger mechanism.

In spray guns of the type which spray atomized particles under the force of relatively high hydrostatic pressures, there exists the problem that sprayed particles in the immediate vicinity forward of the spray tip travel at velocities sufficient to penetrate human skin. If such particles are paint or other body contaminating material they may cause serious infection or other medical complications which require extensive medical treatment. The seriousness of this skin penetration problem is in some way related to the hydrostatic pressure of the sprayed fluid particles, and it is generally assumed that hydrostatic pressures in excess of 1000 pounds per square inch (psi) are sufficiently high to cause skin penetration. This problem requires that a high degree of care be exercised when operating spray guns above the apparent hydrostatic pressure danger lever to avoid close contact with the spray tip. The region of dangerous proximity to the spray tip is apparently several inches or less, it generally being understood that beyond a range of several inches the individual fluid particles have lost sufficient velocity to be unable to penetrate the skin.

It has been found that the quality of spray coating which may be achieved on any given surface generally improves as the hydrostatic pressure of the sprayed paint is increased. Hydrostatic pressures in the range of 2,000–3,000 psi have been found to produce excellent coating results, and such spraying pressures are commonly used in industry. If the hydrostatic pressure is reduced in order to avoid the foregoing problem the resulting degradation in film quality of the coating material is readily apparent. Therefore, while it is necessary to use extreme care in the handling of a spray gun at such elevated pressures, they are nevertheless used at these pressures in order to achieve the desired quality of film coating.

A number of safety features have been devised in the prior art to permit the use of such spray guns at elevated pressures while at the same time providing operator safeguards. For example, U.S. Pat. No. 3,952,955, issued Apr. 27, 1976, and owned by the same assignee as the present invention, discloses a spray tip guard which is connected to the forward exterior end of the spray tip and presents an obstacle and barrier to anyone attempting to insert fingers or hands near the spray tip. U.S. Pat. No. 3,944,141 issued Mar. 16, 1976, discloses a safety hood apparatus for shielding the region forward of the spray tip, and which may be pivotally moved away from the spray tip for cleaning or replacement purposes, but in so doing disables the trigger actuating mechanism. U.S. Pat. No. 3,913,844 issued Oct. 21, 1975 discloses yet another approach to a trigger disabling mechanism which disables the trigger whenever the spray tip locknut is attempted to be removed.

All of the foregoing safety devices provide mechanical means for protecting the operator against inadvertent contact with the spray tip. Since all of them require some degree of maintenance and care they impose a certain degree of responsibility upon the operator to properly maintain and care for them. Unfortunately, an operator who finds this task disagreeable can find ways to defeat each and every one of the foregoing mechanical safety features. It is therefore a desirable object to provide a safety apparatus which may not be disconnected by operator action or otherwise disabled by operator manipulation, and it is an object of the present invention to fulfill this purpose.

SUMMARY OF THE INVENTION

The present invention comprises a solenoid-operated spray gun trigger disabling mechanism, which solenoid must be actuated in order to permit trigger engagement to provide spraying. The solenoid is electronically driven by signals derived from a proximity sensor attached to the spray gun at a position near the spray tip. The proximity sensor is responsive to the presence of a human body member within a predetermined distance, to generate a deactuating signal which is coupled to the solenoid to thereby disengage the spray gun trigger mechanism.

It is therefore an object of the present invention to provide a safety apparatus of the type disclosed herein which will operate in a fail-safe mode, disabling the spray gun trigger mechanism whenever any component of the apparatus fails. It is a further object of the present invention to provide a safety apparatus which activates whenever the operator's hand or other body member comes within a predetermined distance from the spray tip. It is yet another object of the present invention to require that the spray gun trigger be deactivated in order to reset the safety apparatus and therefore permit further spraying to occur. It is a further object of the present invention to provide a safety apparatus which will disable the spray gun trigger mechanism whenever improper maintenance and care have been provided to the safety apparatus, thereby requiring the operator to properly maintain and care for the apparatus.

BRIEF DESCRIPTION OF THE DRAWINGS

The foregoing objects are achieved by the present invention, a preferred embodiment of which is disclosed herein, taken with reference to the appended drawings, in which:

FIG. 2 shows an expanded cross-section view of a portion of FIG. 1; and

FIG. 3 is a cross-section view taken along the lines 3—3 of FIG. 2; and FIG. 4 is an end or front view of a portion of the apparatus.

DESCRIPTION OF THE PREFERRED EMBODIMENT

Figure 1:
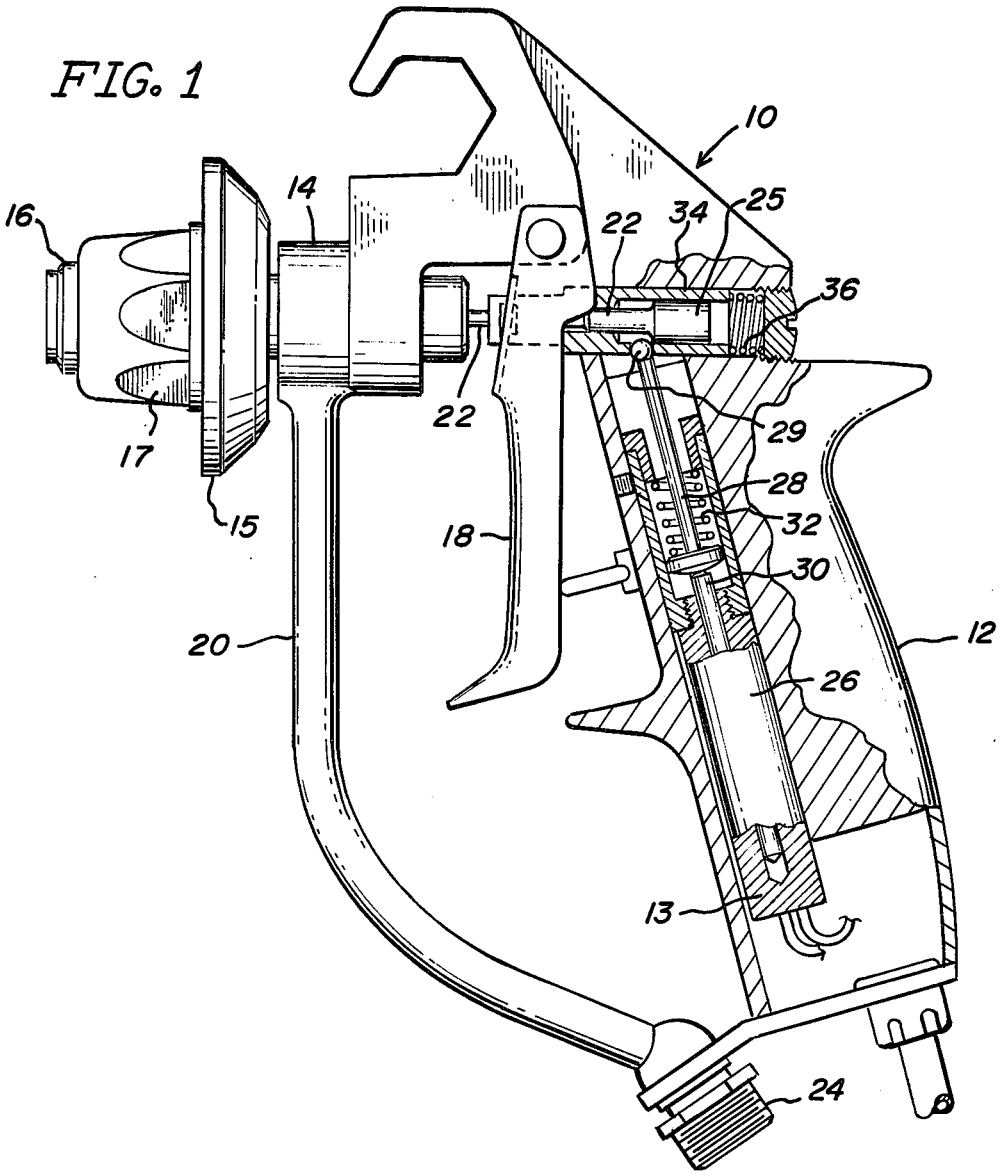
FIG. 1 illustrates a side view in partial cutaway.

Referring first to FIG. 1, the invention is shown in side view, where a portion of spray gun 10 is broken away for illustrative purposes. Spray gun 10 comprises essentially a handle 12, a barrel 14, a nozzle 16, a trigger 18 and a fluid inlet passage 20. A source of pressurized fluid such as paint is coupled to fluid inlet 20 at threaded coupling 24, and the pressurized fluid is admitted into barrel 14. A valve stem 22 is connected to a valve in nozzle 16 to prevent the pressurized fluid from escaping as a spray through nozzle 16 until trigger 18 is squeezed. Trigger 18 is mechanically coupled in a manner which will be described in more detail hereinafter to valve stem 22 to cause the valve to unseat and thereby permit the pressurized fluid to enter nozzle 16 and become sprayed by the apparatus.

Handle 12 has an interior bore 13 which has therein a solenoid 26. Solenoid 26 has a movable actuator 30 which engages against a slide bolt 28. Slide bolt 28 is spring-biased toward actuator 30 by a compression spring 32. The end 29 of slide bolt 28 is preferably formed into a spherical shape, from a material having very good wear characteristics, such as carbide. End 29 fits through a slot in sleeve 34 adjacent valve stem 22 and stop 25.

FIG. 2 illustrates, in cross-section view, the aforementioned valve stem actuating mechanism. Sleeve 34 is slidable within a bore 35 upon actuation of trigger 18. As trigger 18 is moved rightward, sleeve 34 also moves rightward against the force of spring 36. During this travel it contacts slide bolt end 29 and moves it rearward until end 29 contacts stop 25. Since stop 25 is attached to valve stem 22, further rearward movement of trigger 18 causes valve stem 22 to move rearward. This releases the valve in nozzle 16 to permit paint spraying to occur. Slide bolt end 29 is held upwardly to become engaged between sleeve 34 and stop 25 by means of solenoid 26. When solenoid 26 is energized solenoid actuator 30 moves upwardly against slide bolt 28 and forces it upwardly against the spring force 32. When solenoid 26 is deenergized spring 32 forces slide bolt 28 downwardly and solenoid actuator 30 retracts into solenoid 26. Slide bolt 28 is attached to a curved contact plate 33 which permits slide bolt 28 to move laterally within bore 13 while still contacting actuator 30. This enables slide bolt end 29 to move forward and rearward while slide bolt 28 is held upwardly by solenoid 26.

FIG. 3 illustrates a top view taken along the lines 3—3 of FIG. 2. A pair of engaging fingers **18*a* and 18*b*, which form a part of trigger 18, engage corresponding slots in sleeve 34. Therefore when trigger 18 is moved rightwardly fingers 18*a* and 18*b* urge sleeve 34 rightwardly through their engagement in these slots. Movement of cylinder 34 first contacts slide bolt end 29 and causes it to move with cylinder 34. Slide bolt end 29 next contacts stop 25** and causes it to move.

FIG. 4 shows a front end view of a portion of spray gun 10. A sensor housing 15 is positioned in axial alignment with nozzle 16 and in as close proximity to the forward end of nozzle 16 as it practicable. In the spray gun disclosed herein, nozzle 16 is held in fluid sealing relationship to barrel 14 by means of a locknut 17 which is threadable on barrel 14. Sensor housing 15 is positioned immediately behind locknut 17 so as to not interfere with the function of locknut 17. In other embodiments of the invention sensor housing 15 may be placed in closer proximity to the forward end of nozzle 16 so as to maximize the sensitivity of the sensor electronics associated with the invention.

A sensor element 38 is located around the front face of sensor housing 15. FIG. 4 shows sensor element 38 to be a split-ring shape extending around a nearly complete circular path. In other specific embodiments the shape of sensor element 38 may be varied for particular sensitivity requirements. Sensor element 38 is preferably a capacitive sensor element of the type which electrically forms a portion of a circuit which is capacitance-sensitive. As a conductive object, such as a human body member, is brought into proximity with a capacitive-sensitive circuit such as may be connected to sensor element 38, the circuit capacitance changes and the responsiveness of the circuit to this change generates an electrical signal variation. In particular circuits this may be manifested in the form of a frequency-variable signal, a direct current or alternating current voltage level change, or a digital counting mechanism operated within preferential count limits.

Sensor element 38 is electrically connected to electronic circuits, preferably housed within sensor housing 15, for generating appropriate voltage signals for actuating solenoid 26. Because of the limited volume dimensions within sensor housing 15 it is necessary to utilize miniaturized solid state electronic components, and it is preferable to have these components encapsulated in a suitable, state of the art encapsulation process which also attaches sensor element 38 to the front surface of sensor housing 15.

The proximity sensors which may be used in the present invention are preferably either inductive or capacitive, or combinations of both. However, other forms of proximity sensors may be equally well suited to the apparatus, it being the primary function of the sensor to generate a signal or signal change upon proximity of a human body member in the range of 0–12 inches. For example, U.S. Pat. No. 3,836,828, issued Sept. 17, 1974, discloses a proximity sensor utilizing an antenna and resistor-capacitor bridge, to which is coupled an oscillator and other circuitry which generates a signal when a certain level of unbalance in the bridge occurs, which happens when a human body member comes close to the antenna. As another example, U.S. Pat. No. 3,733,597, issued May 15, 1973, discloses a proximity detector and alarm in which an antenna is connected to the gate of a metal oxide semiconductor field effect transistor which causes a silicon controlled switch to trigger a blocking oscillator.

The design disclosed in U.S. Pat. No. 3,764,819, issued Oct. 9, 1973, is particularly advantageous in that it provides a sensor which is responsive to human body members and is unresponsive to other conducting or nonconducting material. Of course, other circuits known in the prior art such as those disclosed in U.S. Pat. Nos. 3,573,783; or 3,947,734; or 3,967,261; or 3,829,850; can also be used with the present invention if they are capable of construction within the volume constraints of sensor housing 15 and they generate an electrical signal responsive to the presence of a human hand or other body member. Housing 15 is preferably kept quite small, having an outer diameter of less than 3 inches and a thickness of less than 1 inch, with a total weight preferably of only a few ounces.

Figure 5:
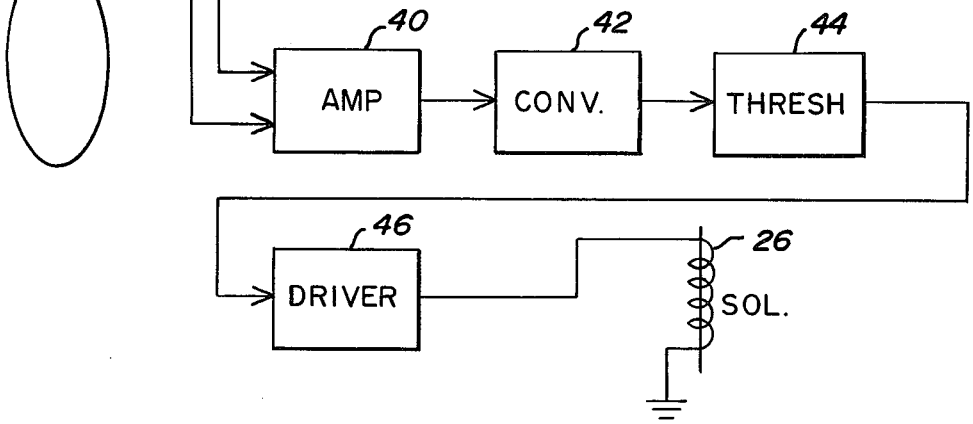
FIG. 5 is a diagram showing the electrical connections of the apparatus.

FIG. 5 diagrammatically shows a typical electronic circuit usable in the present invention. Sensor element 38 is connected to a suitable amplifier 40 which has electrically-balanced circuit components attached thereto, so as to generate an output signal representative of the loading effect of sensor element 38 together with any external circuit loading members. The output signal from amplifier 40 is fed into a converter circuit 42, which generates a signal representative of loading changes which have been sensed by amplifier 40. The output signal from converter circuit 42 is coupled to a switching or threshold circuit 44, which generates an output signal only when the external loading exceeds predetermined values. Thus, the signal from threshold circuit 44 is representative of loading changes in excess of predetermined amounts, and is therefore related to the closeness or proximity of an external member in relationship to sensor 38. The output signal from threshold circuit 44 is transmitted to a solenoid driver circuit 46, which functions as a power amplifier to generate a sufficient electrical signal to energize solenoid 26. In a preferred operating embodiment, the solenoid energizing signal output from driver 46 is present under normal operating conditions, and the signal from threshold circuit 44 serves to disconnect this solenoid drive signal. Therefore, when an operator's body member comes into close proximity with sensor element 38 solenoid 26 is deactivated to cause, in turn, deactivation of the spray gun trigger mechanism.

In operation, the spray gun is connected to a source of pressurized fluid for spraying, and the electronic circuitry is connected to a power supply source. Solenoid 26 is normally actuated to permit trigger 18 to be operated by the operator in a normal fashion, and to thereby permit paint spraying. In the event the operator places his hand or other body member into close proximity with nozzle 16 the electrical elements described hereinbefore cause a signal to be generated to deactivate solenoid 26. The deactivation of solenoid 26 causes slide bolt 28 to fall from its engaged position and thereby disables the trigger mechanism for the spray gun. If the operator's body member is removed from close proximity to the spray gun solenoid 26 once again becomes activated to permit slide bolt 28 to come into engagement with the trigger actuating mechanism. However, trigger 18 must be first released in order for cylinder 34 to return to a position to permit the engagement of slide bolt 28. In a preferred embodiment the electronic circuit elements are selected so as to provide sensitivity to a body member such as a human hand or finger in the range of 0–12 inches from nozzle 16. Variable controls can be attached to the various circuit elements to provide an adjustable range of sensitivity over which the device will operate. In the event the operator fails to properly maintain the spray gun and allows paint to accumulate along the front surface of sensor housing 15 a certain degradation in sensing ability will result with respect to sensor element 38. This degradation will increase the sensitivity of the circuit and will tend to disable the spray gun trigger mechanism prematurely. Eventually, further accumulations of paint and other foreign matter on the front of sensor housing 15 will cause the circuit to permanently disable solenoid 26 and thereby the trigger mechanism. Thus, the operator will be forced to clean and properly maintain the spray gun and sensor element in order to be able to continue to use the spray gun. The system is therefore constructed in a fail-safe mode of operation, even with respect to the requisite care and maintenance required for the spray gun.

The present invention may be embodied in other specific forms without departing from the spirit or essential attributes thereof, and it is therefore desired that the present embodiment be considered in all respects as illustrative and not restrictive, reference being made to the appended claims rather than the foregoing description to indicate the scope of the invention.

What is claimed is:

1. A proximity detector and spray disabling apparatus attachable to a spray gun body for detecting the proximate presence of a human body member and disabling the spray gun spray valve actuating mechanism, comprising:

(a) an electrical sensor element attachable to said spray gun body, said sensor element adapted for providing electrical signals at an output terminal, which signals are indicative of the relative proximity of a human body member to said sensor element;

(b) an electrical solenoid connected to said output terminal, said solenoid having an actuating member which moves in response to said signals;

(c) a trigger actuator engageable in operable arrangement with said spray valve actuating mechanism; and (d) a slide bolt coupled to said solenoid actuating member and moveable to engage and disengage said trigger actuator with said valve actuating mechanism;

Whereby the relative proximity of a human body member to said sensor element causes said trigger actuator to become disengaged with said spray valve actuating mechanism.

2. The apparatus of claim 1, further comprising a spring bias connectable between said spray gun body and said slide bolt for urging said slide bolt away to prevent engagement of said trigger actuator with said valve actuating mechanism when said solenoid is deenergized.

3. The apparatus of claim 1, further comprising means for attaching said solenoid in said spray gun body.

4. The apparatus of claim 1, wherein said sensor element signals are provided at said output terminal when a human body member is in the range of 0–12 inches from said sensor element over a limited directional field.

5. The apparatus of claim 1, wherein said electrical sensor element further comprises an antenna and electrical bridge circuit connected to said antenna.

6. In a fluid spray device adapted for hand holding operation by means of a handle and having a trigger for releasing a fluid valve in a spray nozzle and thereby permitting pressurized fluid to flow through a said nozzle, the improvement comprising:

(a) a trigger and valve engagement means, having a slidable cylinder coupled to said trigger and a movable plunger in said cylinder connected to said fluid valve, and a movable coupling element engageable with said cylinder and said plunger through a wall opening in said cylinder, said movable coupling element being disengaged in a first position and engaged in a second position, for selective spraying of fluid through said nozzle, (b) an electrically-operated solenoid arm contacting said movable coupling element for movement thereof upon electrical actuation of said solenoid;

(c) an electrical sensor attached proximate said nozzle and having thereon an electrical element and circuit for sensing the presence of a human body member and generating an electrical signal in response thereto; and (d) means for coupling said sensor electrical signal to said solenoid for electrical actuation thereof.

7. The apparatus of claim 6, further comprising spring biasing means for urging said movable coupling element away from insertion through said wall opening.

8. The apparatus of claim 7, wherein electrical actuation of said solenoid causes said movable coupling element to become inserted in said wall opening in opposition to the force of said spring biasing means.

9. The apparatus of claim 6, wherein said electrical sensor is attached adjacent said nozzle.

10. The apparatus of claim 9, wherein said circuit generates an electrical signal upon sensing the presence of a human body member in the range of 0–12 inches from said nozzle in a directional field generally encompassing the region of fluid spray.

11. The apparatus of claim 10, wherein said electrical sensor generally surrounds said nozzle.

12. The apparatus of claim 11, wherein said electrical sensor further comprises an antenna and electrical bridge circuit.

* * * * *

UNITED STATES PATENT AND TRADEMARK OFFICE

CERTIFICATE OF CORRECTION

PATENT NO. : 4,162,042

DATED : July 24, 1979

INVENTOR(S) : Gordon V. Mommsen, Dale R. Hemming, Richard E. Hudrlik

It is certified that error appears in the above-identified patent and that said Letters Patent are hereby corrected as shown below:

Change Application No. to 801,035

Signed and Sealed this

*Twenty-ninth* Day of *July 1980*

[SEAL]

*Attest:*

SIDNEY A. DIAMOND

*Attesting Officer*

*Commissioner of Patents and Trademarks*